US007025666B1

(12) United States Patent
Wang

(10) Patent No.: US 7,025,666 B1
(45) Date of Patent: Apr. 11, 2006

(54) BELT SANDER HAVING SAND BELT REPLACEMENT APPARATUS

(76) Inventor: Tien-Wang Wang, 58, Ma Yuan West St., Taichung (TW)

( * ) Notice: Subject to any disclaimer, the term of this patent is extended or adjusted under 35 U.S.C. 154(b) by 0 days.

(21) Appl. No.: 11/111,260

(22) Filed: Apr. 22, 2005

(51) Int. Cl.
*B24B 21/00* (2006.01)

(52) U.S. Cl. ..... 451/296; 451/311

(58) Field of Classification Search ..... 451/311, 451/297, 296, 458, 361; 16/110, 114
See application file for complete search history.

(56) References Cited

U.S. PATENT DOCUMENTS 344,835 A * 7/1886 Hollister ..... 451/311
2,763,103 A * 9/1956 Bader ..... 451/310
2,900,766 A * 8/1959 Robischung ..... 451/311
3,608,245 A * 9/1971 Fair, Jr. et al. ..... 451/300
4,669,224 A * 6/1987 Armstrong et al. ..... 451/296
5,437,570 A * 8/1995 Landhuis ..... 451/296
6,769,974 B1 * 8/2004 Wang ..... 451/311
6,932,686 B1 * 8/2005 Carruth ..... 451/359

* cited by examiner

*Primary Examiner*—Robert A. Rose
(74) *Attorney, Agent, or Firm*—Alan D. Kamrath; Nikolai & Mersereau, P.A.

(57) ABSTRACT

A belt sander includes a main frame, a drive roller, a driven roller, a sand belt, and a sand belt replacement apparatus. Thus, the user only needs to rotate the control handle to move the driven roller relative to the drive roller so as to change the distance between the drive roller and the driven roller so that the user can adjust the tension of the sand belt easily and rapidly, thereby facilitating the user adjusting the tension of the sand belt, and thereby facilitating the user mounting and replacing the sand belt.

17 Claims, 9 Drawing Sheets

BELT SANDER HAVING SAND BELT REPLACEMENT APPARATUS

BACKGROUND OF THE INVENTION

1. Field of the Invention

The present invention relates to a belt sander, and more particularly to a belt sander having a sand belt replacement apparatus.

2. Description of the Related Art

A conventional belt sander in accordance with the prior art shown in FIG. 10 is disclosed in the applicant's U.S. Pat. No. 6,769,974-B2 and comprises a drive roller 3, a driven roller 4, a tension spring 1, and an operation lever 2. When the sand belt mounted between the drive roller 3 and the driven roller 4 is worn out for replacement, the operation lever 2 is pressed downward to compress the tension spring 1 to loosen the sand belt mounted between the drive roller 3 and the driven roller 4, thereby facilitating the user removing the sand belt.

However, the user's one hand has to press the operation lever 2 and his other hand has to remove the worn sand belt and replace a new sand belt, thereby causing inconvenience to the user when mounting and replacing the sand belt. In addition, the operation lever 2 is easily touched and triggered by a person unintentionally, so that the sand belt is easily loosened, thereby causing danger to the user during operation of the belt sander.

SUMMARY OF THE INVENTION

The primary objective of the present invention is to provide a belt sander having a sand belt replacement apparatus that can mount and replace the sand belt easily and rapidly.

Another objective of the present invention is to provide a belt sander, wherein the user only needs to rotate the control handle to move the driven roller relative to the drive roller so as to change the distance between the drive roller and the driven roller so that the user can adjust the tension of the sand belt easily and rapidly, thereby facilitating the user adjusting the tension of the sand belt, and thereby facilitating the user mounting and replacing the sand belt.

A further objective of the present invention is to provide a belt sander, wherein the user can operate the control handle to adjust the tension of the sand belt in a easier manner, thereby saving the manual work.

A further objective of the present invention is to provide a belt sander, wherein the locking bolt is screwed into the second end of the rotation shaft closely to lock the control handle on the rotation shaft, so that the control handle is locked by the locking bolt and cannot rotate the rotation shaft, thereby preventing the control handle from being rotated freely by a person unintentionally.

Further benefits and advantages of the present invention will become apparent after a careful reading of the detailed description with appropriate reference to the accompanying drawings.

DETAILED DESCRIPTION OF THE INVENTION

Figure 1:
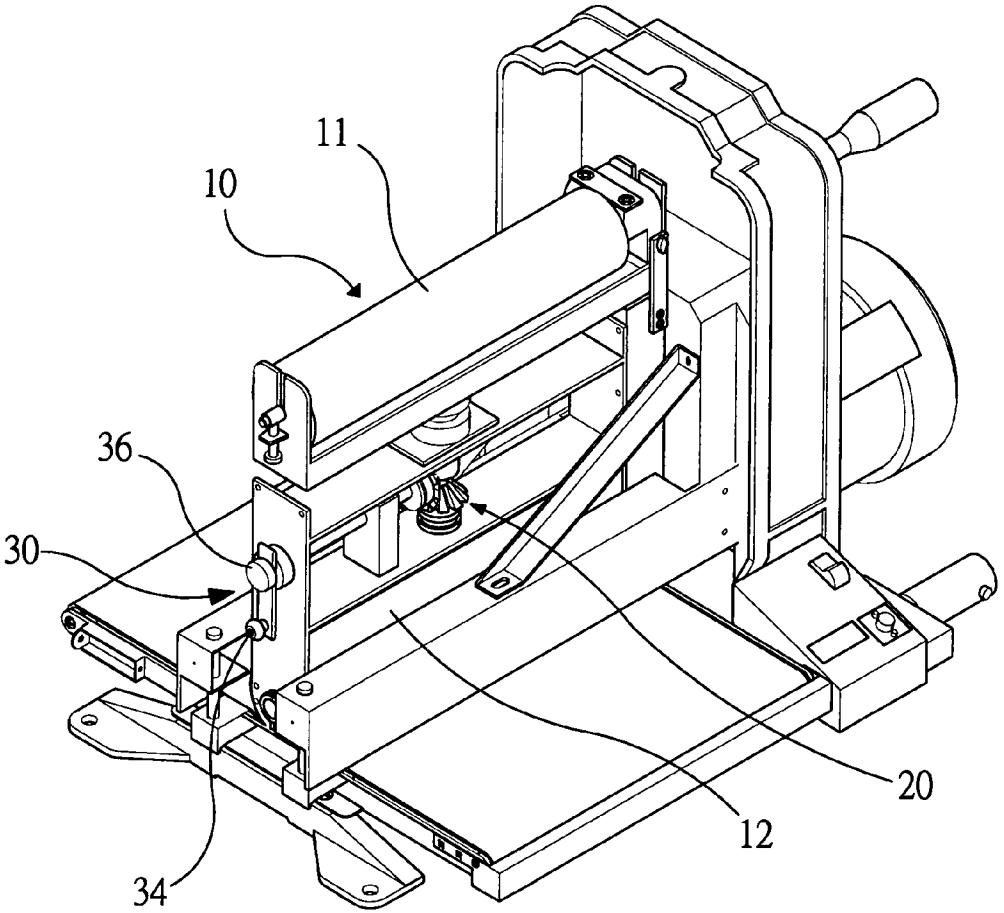
FIG. 1 is a perspective view of a belt sander in accordance with the preferred embodiment of the present invention.
Figure 2:
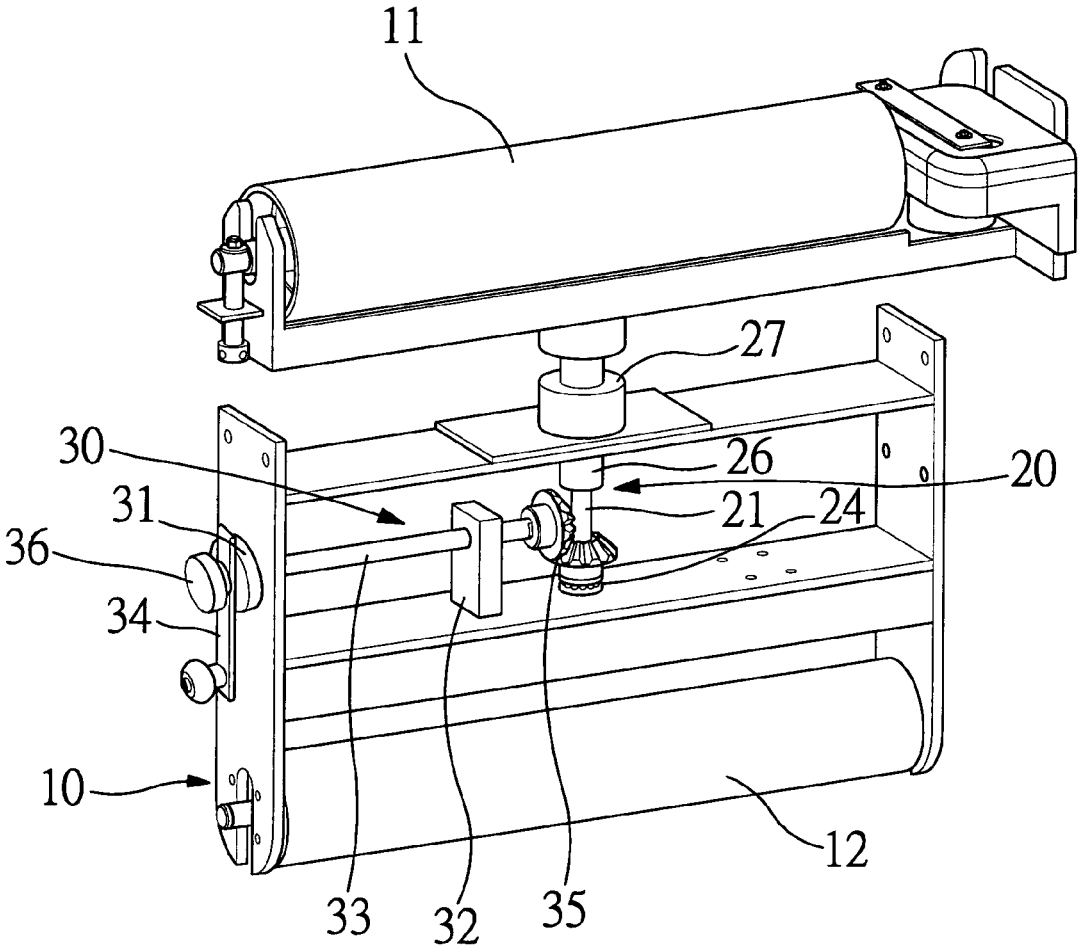
FIG. 2 is a partially perspective view of the belt sander as shown in FIG. 1.
Figure 3:
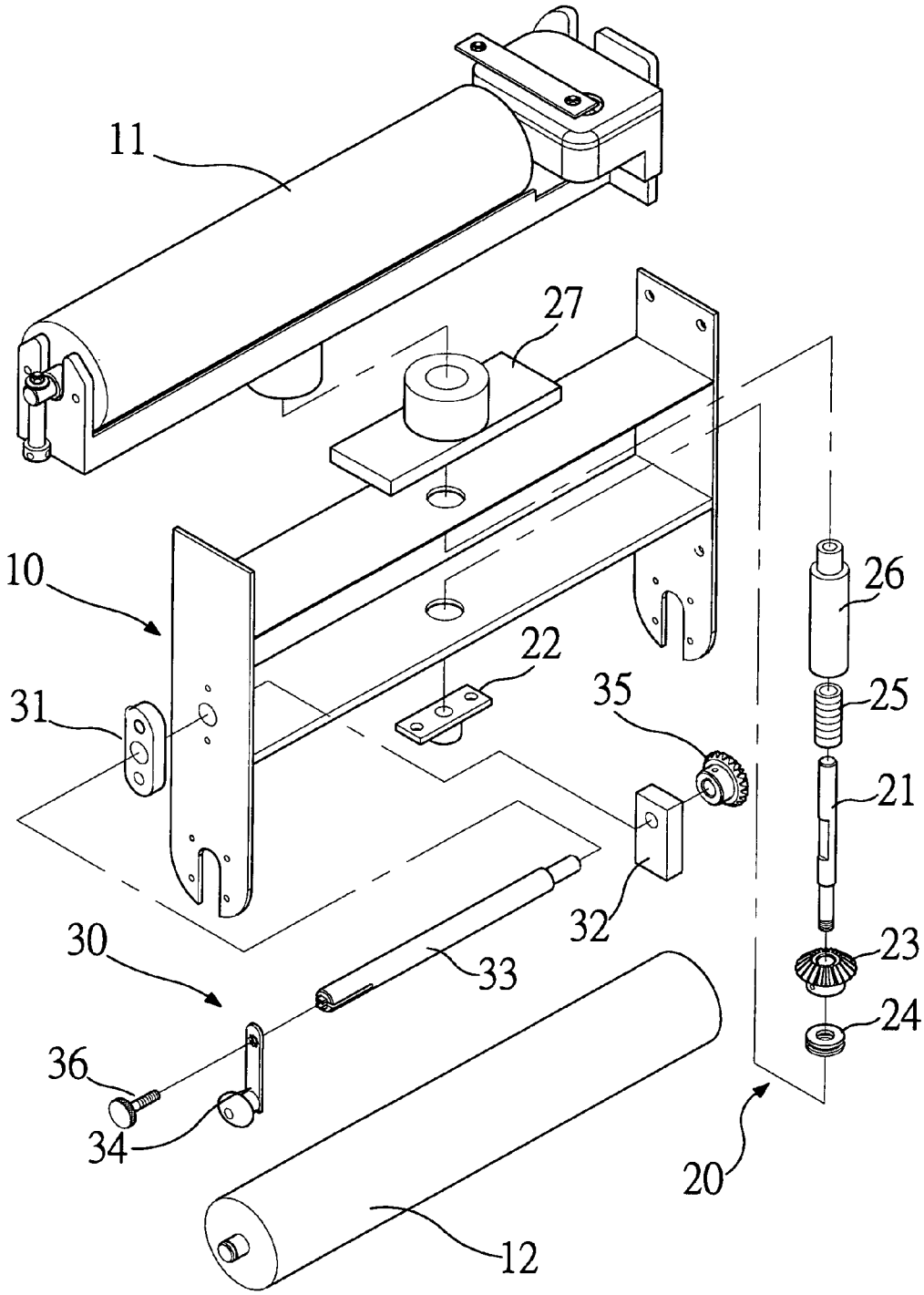
FIG. 3 is an exploded perspective view of the belt sander as shown in FIG. 2.
Figure 4:
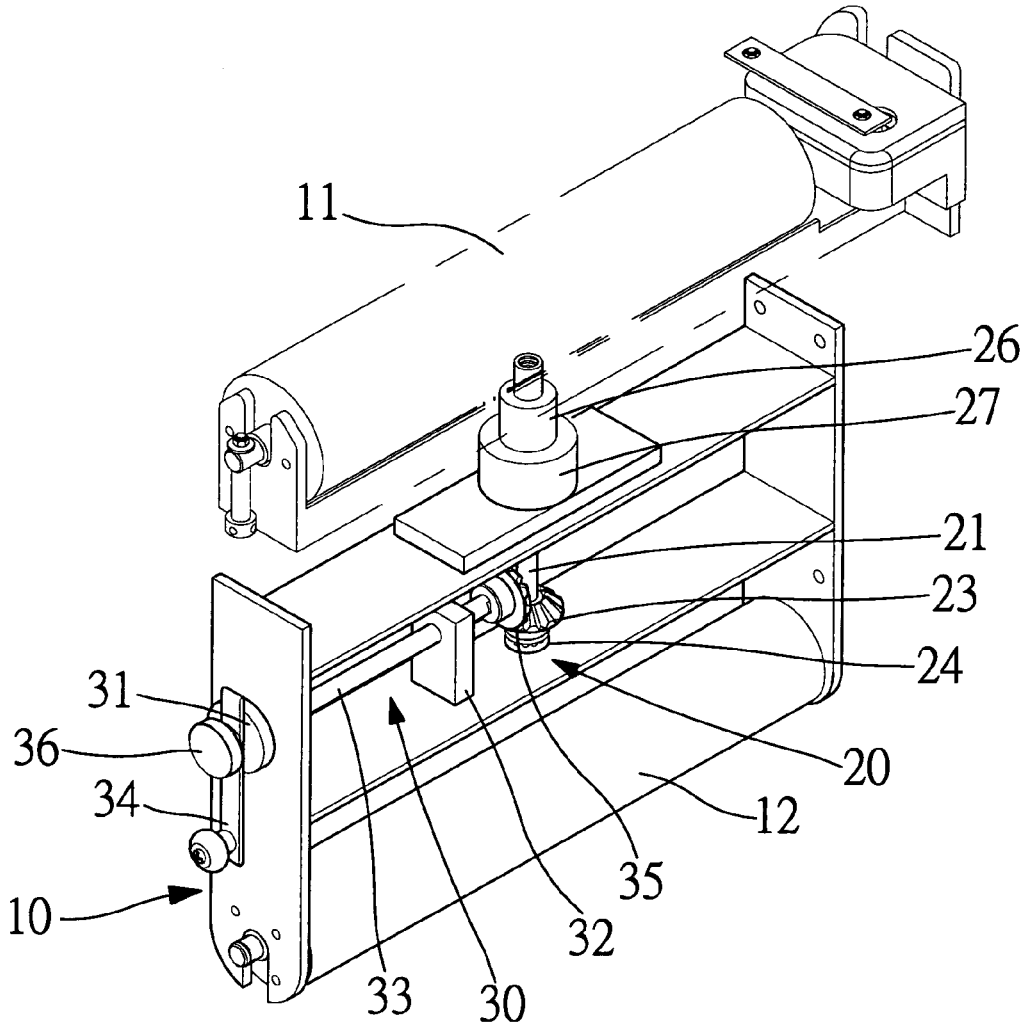
FIG. 4 is a schematic operational view of the belt sander as shown in FIG. 2.
Figure 5:
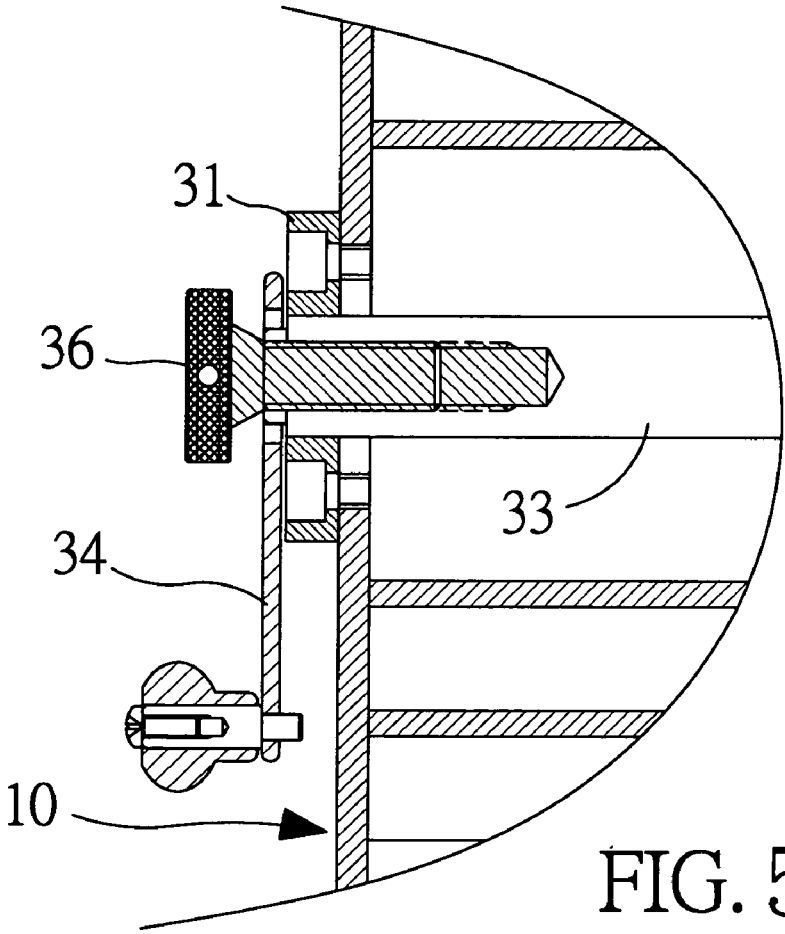
FIG. 5 is a locally enlarged plan cross-sectional view of the belt sander as shown in FIG. 2.
Figure 6:
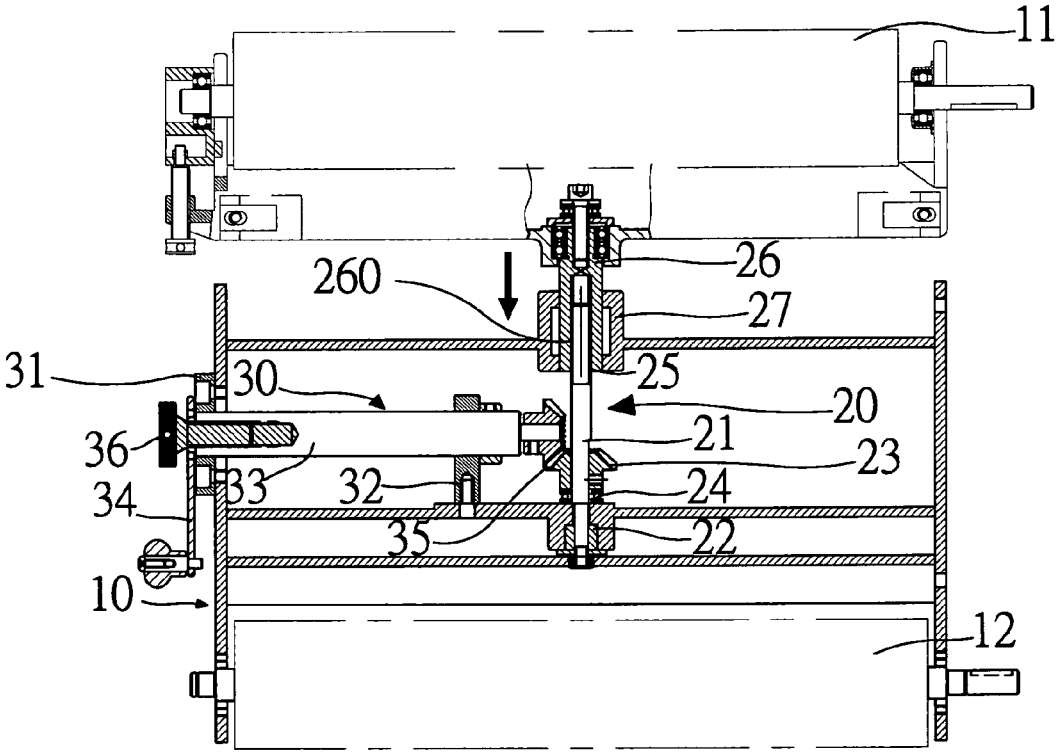
FIG. 6 is a plan cross-sectional view of the belt sander as shown in FIG. 2.

Referring to the drawings and initially to FIGS. 1–6, a belt sander in accordance with the preferred embodiment of the present invention comprises a main frame 10, a drive roller 12 rotatably mounted on the main frame 10, a driven roller 11 rotatably mounted on the main frame 10, a sand belt (not shown) mounted between the drive roller 12 and the driven roller 11, and a sand belt replacement apparatus mounted on the main frame 10 for driving the driven roller 11 to move relative to the drive roller 12 so as to adjust a distance between the drive roller 12 and the driven roller 11 to facilitate a user replacing the sand belt.

The sand belt replacement apparatus includes a lifting mechanism 20 and an adjusting mechanism 30.

The lifting mechanism 20 includes a lifting rod 26 movably mounted on the main frame 10 and having a hollow lower end formed with an inner thread 260 (see FIG. 6) and an upper end connected to the driven roller 11 to drive the driven roller 11 to move relative to the drive roller 12, a threaded rod 21 rotatably mounted on the main frame 10 and having an upper end provided with an outer thread 25 screwed into the inner thread 260 of the lifting rod 26 to move the lifting rod 26 by rotation of the threaded rod 21, a first bevel gear 23 secured on a lower end of the threaded rod 21 by a locking nut 24 for rotating the threaded rod 21, an upper positioning member 27 mounted on the main frame 10 and mounted on the lifting rod 26 to facilitate movement of the lifting rod 26, and a lower positioning member 22 mounted on the main frame 10 and mounted on the lower end of the threaded rod 21 to facilitate rotation of the threaded rod 21.

The adjusting mechanism 30 includes a rotation shaft 33 rotatably mounted on the main frame 10, a second bevel gear 35 secured on a first end of the rotation shaft 33 to rotate therewith and meshing with the first bevel gear 23 for rotating the first bevel gear 23, a support member 32 secured on the main frame 10 and mounted on a mediate portion of the rotation shaft 33 to support the rotation shaft 33, a control handle 34 secured on a second end of the rotation shaft 33 for rotating the rotation shaft 33, a locking bolt 36 extended through the control handle 34 and screwed into the second end of the rotation shaft 33, and a pivot seat 31 secured on the main frame 10 and mounted between the rotation shaft 33 and the control handle 34. The second end of the rotation shaft 33 is protruded outward from the main frame 10, and the pivot seat 31 is mounted on the second end of the rotation shaft 33 and rested on the control handle 34 to facilitate the control handle 34 rotating the rotation shaft 33. The locking bolt 36 is mounted on a connection of the control handle 34 and the rotation shaft 33.

When the locking bolt 36 is screwed into the second end of the rotation shaft 33 closely to lock the control handle 34 on the rotation shaft 33, the control handle 34 is locked by the locking bolt 36 and cannot rotate the rotation shaft 33, and when the locking bolt 36 is unscrewed from the second end of the rotation shaft 33, the control handle 34 is unlocked from the locking bolt 36 and can rotate the rotation shaft 33.

Figure 7:
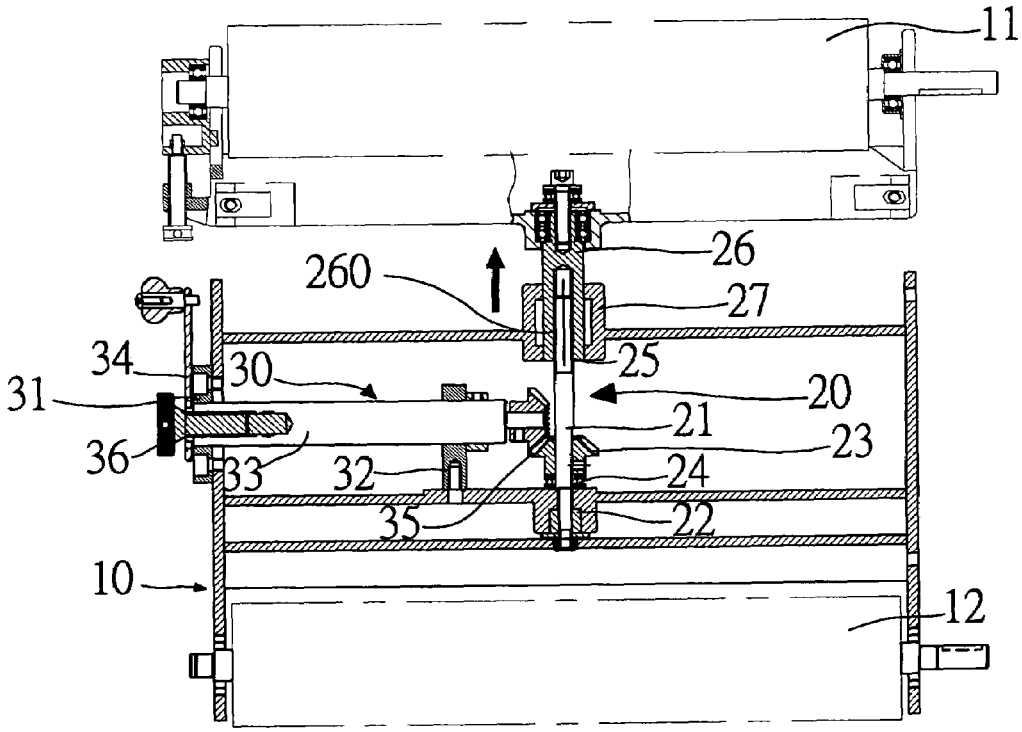
FIG. 7 is a schematic operational view of the belt sander as shown in FIG. 6.
Figure 8:
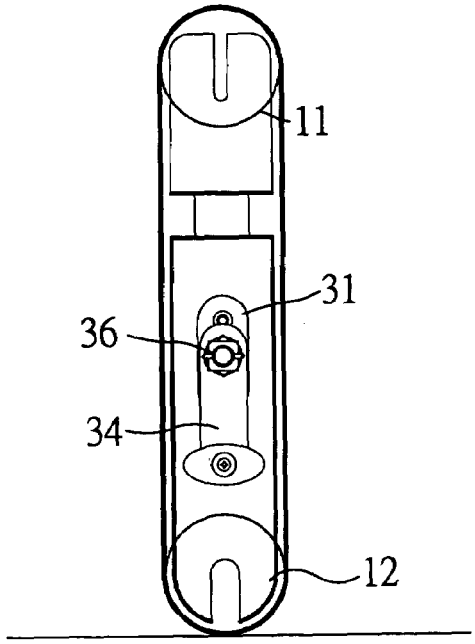
FIG. 8 is a side plan view of the belt sander as shown in FIG. 2.
Figure 9:
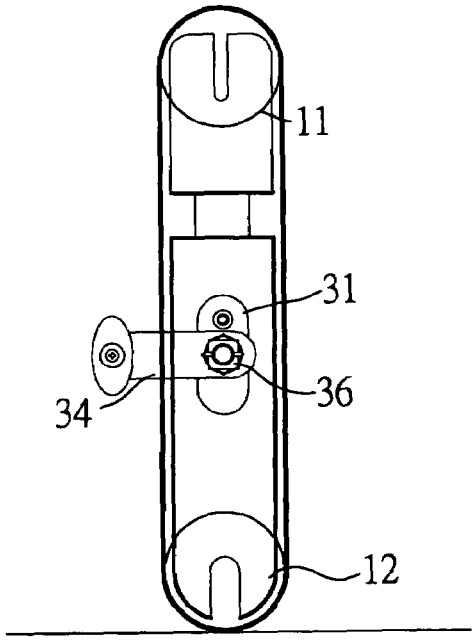
FIG. 9 is a schematic operational view of the belt sander as shown in FIG. 8.
Figure 10:
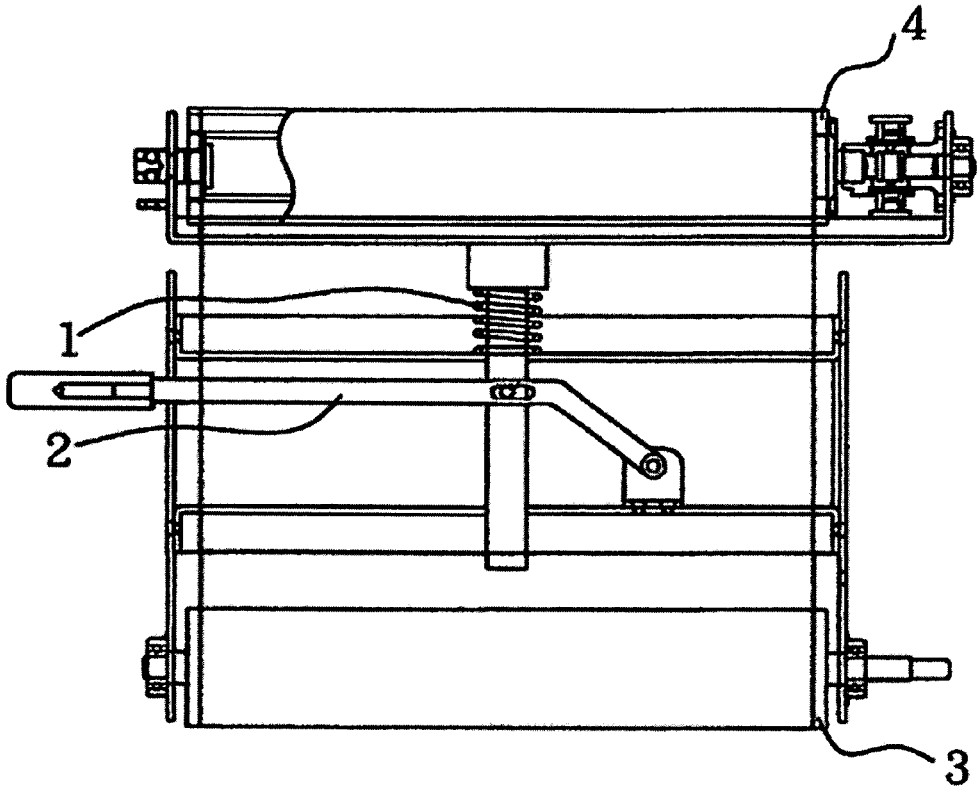
FIG. 10 PRIOR ART
FIG. 10 is a plan view of a conventional belt sander in accordance with the prior art.

In operation, referring to FIGS. 6–9 with reference to FIGS. 1–5, when the control handle 34 is rotated in the counterclockwise direction, the rotation shaft 33 and the second bevel gear 35 are rotated in the counterclockwise direction, so that the first bevel gear 23 is rotated in the counterclockwise direction so as to rotate the threaded rod 21 and the outer thread 25 in the counterclockwise direction. Thus, the outer thread 25 of the threaded rod 21 is rotated in the counterclockwise direction, so that the outer thread 25 of the threaded rod 21 is screwed into the inner thread 260 of the lifting rod 26 to drive the lifting rod 26 to move downward so as to drive the driven roller 11 to move downward. Thus, the driven roller 11 is moved toward the drive roller 12 to shorten the distance between the drive roller 12 and the driven roller 11 so as to loosen the sand belt, thereby facilitating the user replacing the sand belt.

Alternatively, when the control handle 34 is rotated in the clockwise direction, the rotation shaft 33 and the second bevel gear 35 are rotated in the clockwise direction, so that the first bevel gear 23 is rotated in the clockwise direction so as to rotate the threaded rod 21 and the outer thread 25 in the clockwise direction. Thus, the outer thread 25 of the threaded rod 21 is rotated in the clockwise direction, so that the outer thread 25 of the threaded rod 21 is unscrewed from the inner thread 260 of the lifting rod 26 to drive the lifting rod 26 to move upward so as to drive the driven roller 11 to move upward. Thus, the driven roller 11 is moved outward relative to the drive roller 12 to increase the distance between the drive roller 12 and the driven roller 11 so as to tighten the new sand belt, thereby facilitating the user mounting the new sand belt.

Accordingly, the user only needs to rotate the control handle 34 to move the driven roller 11 relative to the drive roller 12 so as to change the distance between the drive roller 12 and the driven roller 11 so that the user can adjust the tension of the sand belt easily and rapidly, thereby facilitating the user adjusting the tension of the sand belt, and thereby facilitating the user mounting and replacing the sand belt. In addition, the control handle 34 has a radius of rotation greater than the diameter of the second bevel gear 35, and the first bevel gear 23 has a diameter greater than that of the outer thread 25 of the threaded rod 21, so that the user can operate the control handle 34 to adjust the tension of the sand belt in a easier manner (because the applying force arm is greater than the resistance force arm), thereby saving the manual work. Further, the locking bolt 36 is screwed into the second end of the rotation shaft 33 closely to lock the control handle 34 on the rotation shaft 33, so that the control handle 34 is locked by the locking bolt 36 and cannot rotate the rotation shaft 33, thereby preventing the control handle 34 from being rotated freely by a person unintentionally.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A sand belt replacement apparatus for a belt sander, comprising:

a lifting mechanism including:

a lifting rod having a hollow lower end formed with an inner thread;

a threaded rod having an upper end provided with an outer thread screwed into the inner thread of the lifting rod to move the lifting rod by rotation of the threaded rod; wherein the lifting mechanism further includes a first bevel gear secured on a lower end of the threaded rod for rotating the threaded rod, and the sand belt replacement apparatus further comprises an adjusting mechanism including a rotation shaft rotatable mounted on the main frame, a second bevel gear secured on a first end of the rotation shaft to rotate therewith and meshing with the first bevel gear for rotating the first bevel gear, and a control handle secured on a second end of the rotation shaft for rotating the rotation shaft;

the adjusting mechanism further includes a locking bolt extended through the control handle and screwed into the second end of the rotation shaft;

the locking bolt is screwed into the second end of the rotation shaft to lock the control handle on the rotation shaft, so that the control handle is locked by the locking bolt and cannot rotate the rotation shaft.

2. The sand belt replacement apparatus in accordance with claim 1, wherein the lifting rod is movably mounted on a main frame.

3. The sand belt replacement apparatus in accordance with claim 1, wherein the lifting rod has an upper end connected to a driven roller to drive the driven roller to move relative to a drive roller.

4. The sand belt replacement apparatus in accordance with claim 1, wherein the threaded rod is rotatably mounted on a main frame.

5. The sand belt replacement apparatus in accordance with claim 1, wherein the lifting mechanism further includes an upper positioning member mounted on the lifting rod to facilitate movement of the lifting rod.

6. The sand belt replacement apparatus in accordance with claim 5, wherein the upper positioning member is mounted on a main frame.

7. The sand belt replacement apparatus in accordance with claim 1, wherein the lifting mechanism further includes a lower positioning member mounted on the lower end of the threaded rod to facilitate rotation of the threaded rod.

8. The sand belt replacement apparatus in accordance with claim 7, wherein the lower positioning member is mounted on a main frame.

9. The sand belt replacement apparatus in accordance with claim 1, wherein the first bevel gear is secured on the lower end of the threaded rod by a locking nut.

10. The sand belt replacement apparatus in accordance with claim 1, wherein the locking bolt is mounted on a connection of the control handle and the rotation shaft.

11. A sand belt replacement apparatus for a belt sander, comprising:

a lifting mechanism including:

a lifting rod having a hollow lower end formed with an inner thread;

a threaded rod having an upper end provided with an outer thread screwed into the inner thread of the lifting rod to move the lifting rod by rotation of the threaded rod; wherein the lifting mechanism further includes a first bevel gear secured on a lower end of the threaded rod for rotating the threaded rod, and the sand belt replacement apparatus further comprises an adjusting mechanism including a rotation shaft rotatable mounted on the main frame, a second bevel gear secured on a first end of the rotation shaft to rotate therewith and meshing with the first bevel gear for rotating the first bevel gear, and a control handle secured on a second end of the rotation shaft for rotating the rotation shaft;

the adjusting mechanism further includes a locking bolt extended through the control handle and screwed into the second end of the rotation shaft;

the locking bolt is unscrewed from the second end of the rotation shaft, so that the control handle is unlocked from the locking bolt and can rotate the rotation shaft.

12. The sand belt replacement apparatus in accordance with claim 1, wherein the adjusting mechanism further includes a support member mounted on a mediate portion of the rotation shaft to support the rotation shaft.

13. The sand belt replacement apparatus in accordance with claim 12, wherein the support member is secured on a main frame.

14. The sand belt replacement apparatus in accordance with claim 1, wherein the adjusting mechanism further includes a pivot seat mounted between the rotation shaft and the control handle.

15. The sand belt replacement apparatus in accordance with claim 14, wherein the pivot seat is secured on a main frame.

16. A sand belt replacement apparatus for a belt sander, comprising:

a lifting mechanism including:

a lifting rod having a hollow lower end formed with an inner thread;

a threaded rod having an upper end provided with an outer thread screwed into the inner thread of the lifting rod to move the lifting rod by rotation of the threaded rod; wherein the lifting mechanism further includes a first bevel gear secured on a lower end of the threaded rod for rotating the threaded rod, and the sand belt replacement apparatus further comprises an adjusting mechanism including a rotation shaft rotatable mounted on the main frame, a second bevel gear secured on a first end of the rotation shaft to rotate therewith and meshing with the first bevel gear for rotating the first bevel gear, and a control handle secured on a second end of the rotation shaft for rotating the rotation shaft;

the adjusting mechanism further includes a pivot seat mounted between the rotation shaft and the control handle;

the second end of the rotation shaft is protruded outward from the main frame, and the pivot seat is mounted on the second end of the rotation shaft and rested on the control handle to facilitate the control handle rotating the rotation shaft.

17. The sand belt replacement apparatus in accordance with claim 1, wherein the control handle has a radius of rotation greater than the diameter of the second bevel gear, and the first bevel gear has a diameter greater than that of the outer thread of the threaded rod.

* * * * *